US007213711B2

(12) United States Patent
Wang

(10) Patent No.: US 7,213,711 B2
(45) Date of Patent: May 8, 2007

(54) ON STRUCTURE OF A CONTAINER

(75) Inventor: Chih-Hung Wang, Tainan Hsien (TW)

(73) Assignee: Duo Yeu Metal Co., Ltd., Tainan Hsien (TW)

( * ) Notice: Subject to any disclaimer, the term of this patent is extended or adjusted under 35 U.S.C. 154(b) by 421 days.

(21) Appl. No.: 10/978,578

(22) Filed: Nov. 2, 2004

(65) Prior Publication Data

US 2006/0091042 A1 May 4, 2006

(51) Int. Cl.
*B65D 25/54* (2006.01)

(52) U.S. Cl. ..... 206/776; 206/459.5

(58) Field of Classification Search ..... 206/776, 206/781, 782, 1.5, 459.5, 459.1; 40/720–722, 40/725; 220/8; 215/383; 222/129, 131, 222/192, 251

See application file for complete search history.

(56) References Cited

U.S. PATENT DOCUMENTS 5,913,419 A * 6/1999 Doodson ..... 206/308.1
6,216,856 B1 * 4/2001 Park ..... 206/214
7,097,069 B2 * 8/2006 Cavanagh ..... 221/312 R
2003/0155271 A1 * 8/2003 Menceles ..... 206/583

* cited by examiner

*Primary Examiner*—Shian T. Luong
(74) *Attorney, Agent, or Firm*—Rosenberg, Klein & Lee

(57) ABSTRACT

A container includes a transparent containing body, a metallic outer layer member, and an upper part; the containing body has a base, and a wall projecting from the base, which wall has a raised portion on a portion of an outer side, and a recess portion on the other portion of the outer side; the base is formed with a fitting trench thereon, which is next to the recess portion of the wall; the outer layer member is closely fitted over the recess portion, and inserted into the fitting trench of the base at a lower end; the upper part has an opening, and a fitting trench on a lower side thereof, and it is secured on top of both the containing body and the outer layer member with an upper end of the outer layer member being inserted into the fitting trench thereof.

5 Claims, 8 Drawing Sheets

ON STRUCTURE OF A CONTAINER

BACKGROUND OF THE INVENTION

1. Field of the Invention

The present invention relates to a container, more particularly one, which includes a transparent plastic containing part, and a metallic outer layer securely fitted on a portion of the plastic containing part such that people can see the contents thereof through a portion of the enclosing wall of the containing body that isn't covered with the outer layer.

2. Brief Description of the Prior Art

Transparent plastic containers are available, which allows people to see the contents without opening the lids while there are no transparent metallic containers available. However, plastic containers usually are cheaper than and don't look as high class as metallic ones. Therefore, some manufactures have developed various new containers that are comprised of metallic parts and plastic ones.

Referring to FIG. 10, a prior container includes a metallic outer part 61, and an inner part 62; the outer part 61 is formed with several ornamental holes 611 on the wall portion. The inner part 62 is made of transparent plastics, and it is closely fitted in and stuck to the outer part 61; thus, people can see the contents of the container through the holes 611 of the metallic outer part 61. Because plastics and metals have different coefficients of expansion, the adhesion between the inner and the outer parts 62, 61 is prone to reduce owing to change of temperature. Consequently, the inner and the outer parts 62, 61 are no longer firmly joined.

An improvement on container was disclosed in U.S. Pat. No. 6,341,712B1 and U.S. Pat. No. 6,349,841B1, which includes a metallic inner barrel part, and a plastic outer part, which inner part has several ornamental holes thereon, and which outer part is directly formed over the inner part, with some portions thereof projecting into the ornamental holes, by means of injection molding. Therefore, the advantages of plastic containers and metallic ones are combined. However, the inner and the outer parts of the container are prone to lose the firm connection between them, and in turns separate from each other, because they have different coefficients of expansion.

SUMMARY OF THE INVENTION

It is a main object of the invention to provide an improvement on a container to overcome the above disadvantage.

The container of the present invention includes a transparent containing body, a metallic outer layer member, and an upper part. The containing body has a base, and a wall projecting from the base, which wall has a raised portion on a portion of an outer side, and a recess portion on the other portion of the outer side. The base has a trench thereon, which is next to the recess portion of the wall. The outer layer member is closely fitted over the recess portion, and inserted into the trench of the base at a lower end. The upper part has an opening, and a trench on a lower side thereof, and it is securely disposed on top of both the containing body and the outer layer member with an upper end of the outer layer member being inserted into the trench thereof.

BRIEF DESCRIPTION OF THE DRAWINGS

The present invention will be better understood by referring to the accompanying drawings, wherein.

DETAILED DESCRIPTION OF THE PREFERRED EMBODIMENTS

Figure 1:
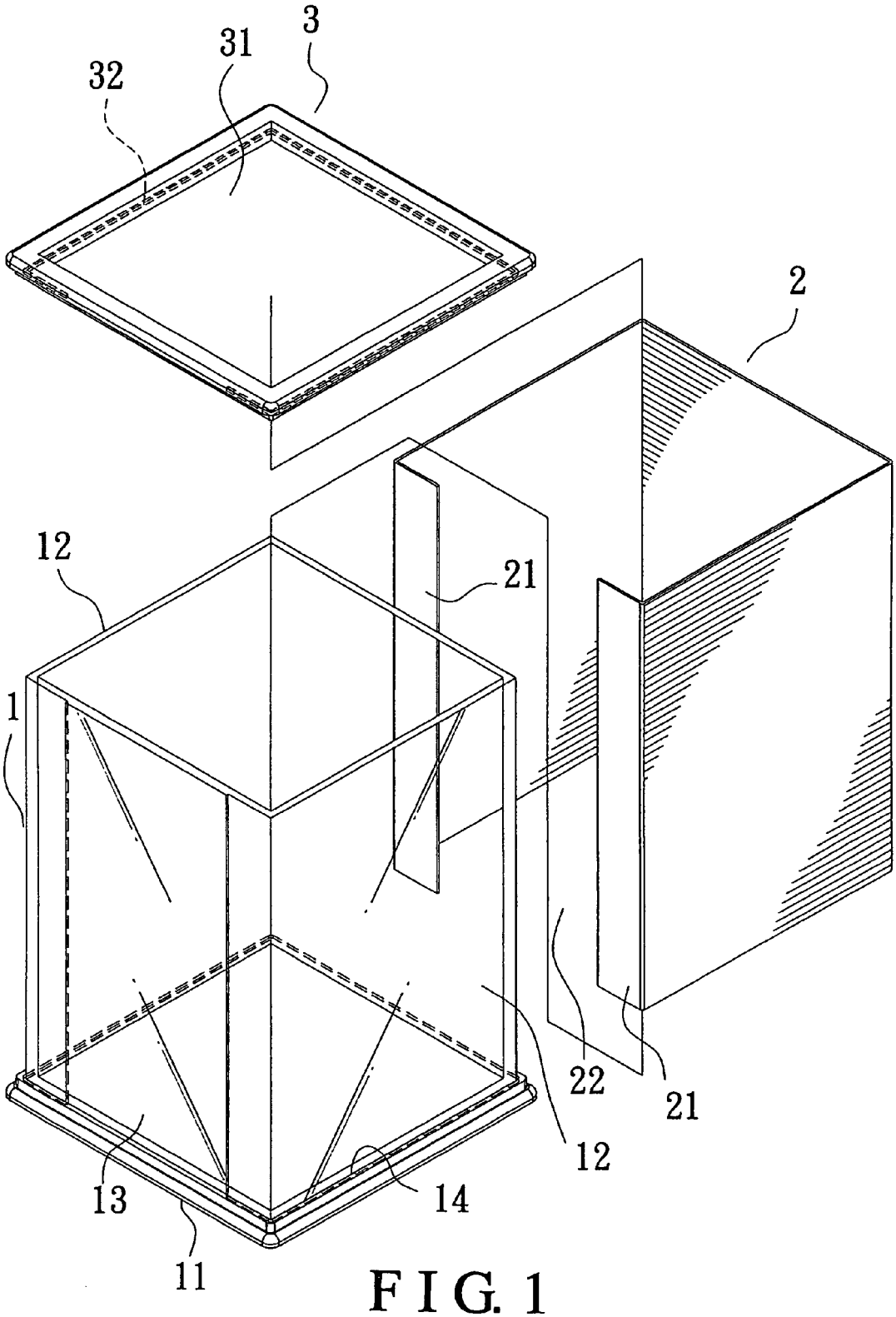
FIG. 1 is an exploded perspective view of the first embodiment of a container according to the present invention.
Figure 2:
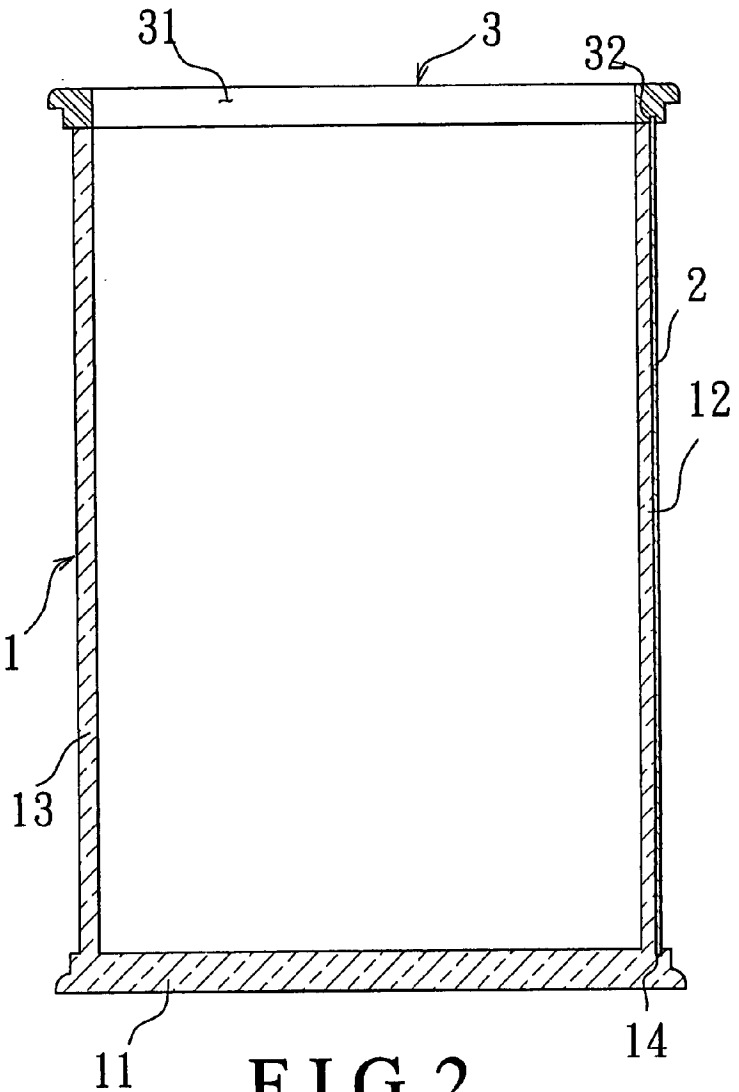
FIG. 2 is a vertical section of the first embodiment.
Figure 3:
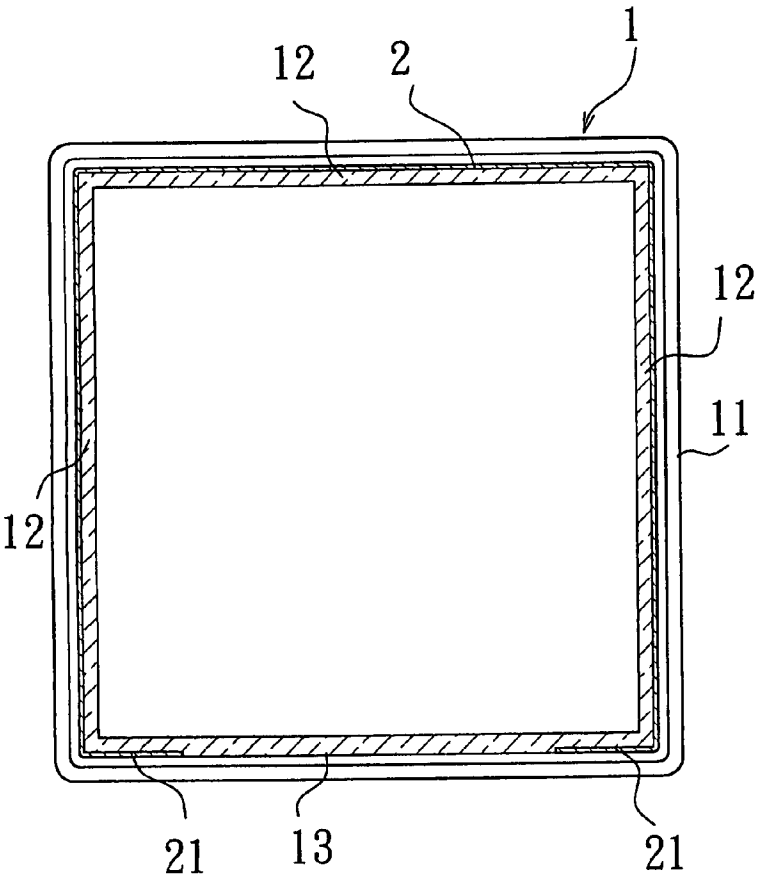
FIG. 3 is a horizontal section of the first embodiment.

Referring to FIGS. 1 to 3, a first embodiment of a container includes a containing body 1, an outer layer member 2, and an upper part 3.

The containing body 1 is transparent, and it has a base 11, and a wall 12 projecting up from the base 11. The wall 12 has a raised portion 13 on a portion of an outer side, and a recess portion on the other portion of the outer side. The base 11 is formed with a fitting trench 14 on an upper side, which is next to the recess portion of the wall 12, and which is connected to two sides of the raised portion 13 of the wall 12 at two ends thereof.

The outer layer member 2 is made of metal, and formed with two folded vertical edge portions 21 and an opening 22 between the folded edge portions 21, and it is bent such that it can closely fit over the recess portion of the wall 12 of the containing body 1; the width of the opening 22 is equal to that of the raised portion 13 of the wall 12.

The upper part 3 has an opening 31, and a fitting trench 32 on a lower side.

Figure 4:
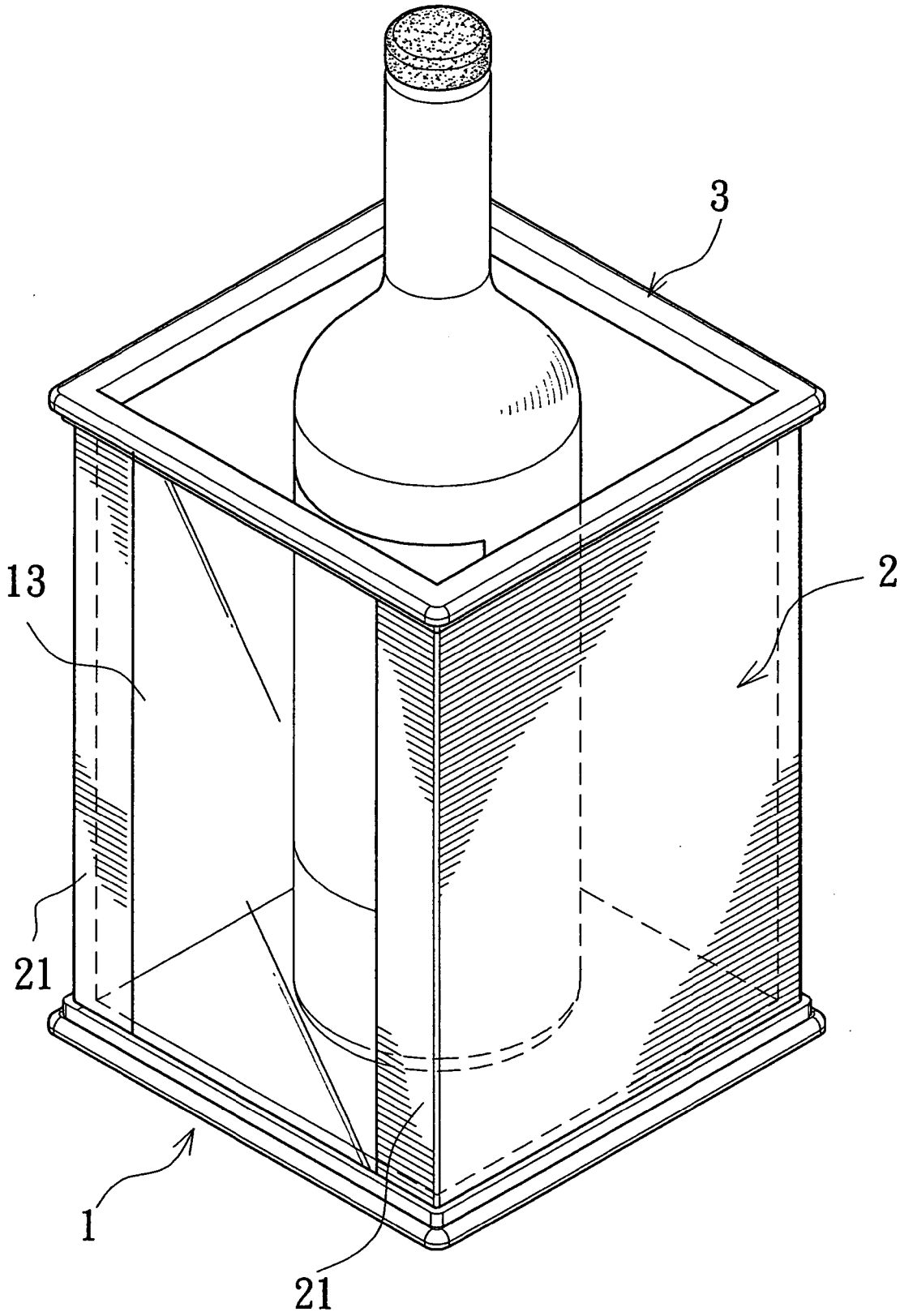
FIG. 4 is a perspective view of the first embodiment in use.

In assembly, the outer layer member 2 is closely fitted over the recess portion of the wall 12, and inserted into the fitting trench 14 of the base 11 at a lower end, touching two sides of the raised portion 13 at the folded edge portions 21 thereof. And, the upper part 3 is disposed on top of the containing body 1 and the outer layer member 2 with the upper end of the outer layer member 2 being inserted into the fitting trench 32 thereof. Thus, people can see objects held in the container through the raised portion 13 of the wall 12 of the transparent containing body 1, as shown in FIG. 4.

Figure 5:
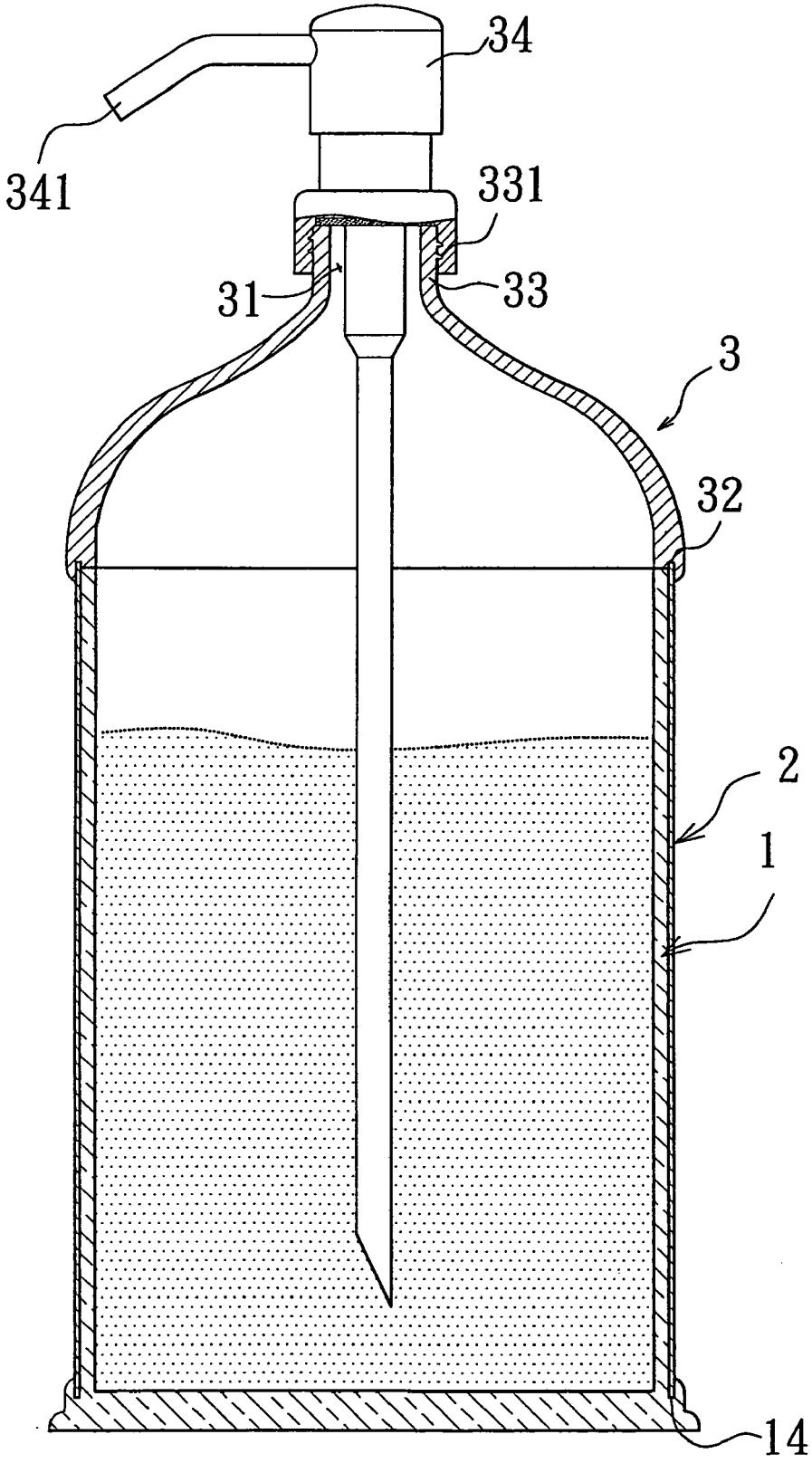
FIG. 5 is a horizontal section of the second embodiment of a container in the present invention.

Referring to FIG. 5, a second embodiment of the present invention includes a depressible ejecting member 34, and upper part 3, which is formed with a neck portion 33 instead, and screw threads 331 on the neck portion 33. The depressible ejecting member 34 is screwed onto the neck portion 33 of the upper part 3, and it is made in such a way as to be capable of ejecting contents of the container via an outlet 341 thereof when it is depressed.

Figure 6:
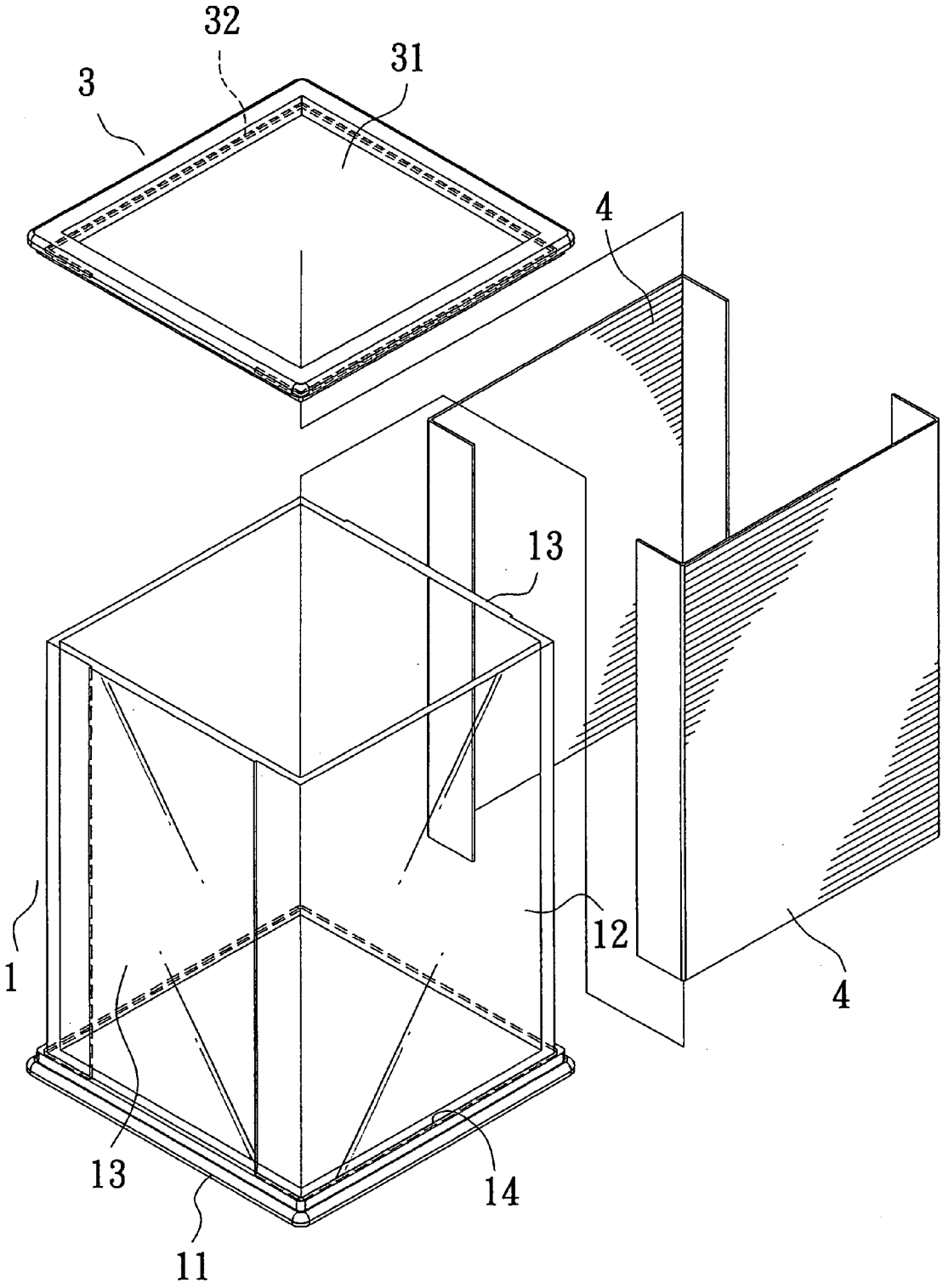
FIG. 6 is an exploded perspective view of the third embodiment.

Referring to FIG. 6, a third embodiment of the present invention includes two outer layer members 4 instead, and containing body 1 whose wall 12 is formed with two raised portions 13 as well as two recess portions on the outer side instead; the outer layer members 4 are respectively fitted onto the recess portions of the wall 12 with the edges thereof touching the edges of the raised portions 13.

Figure 7:
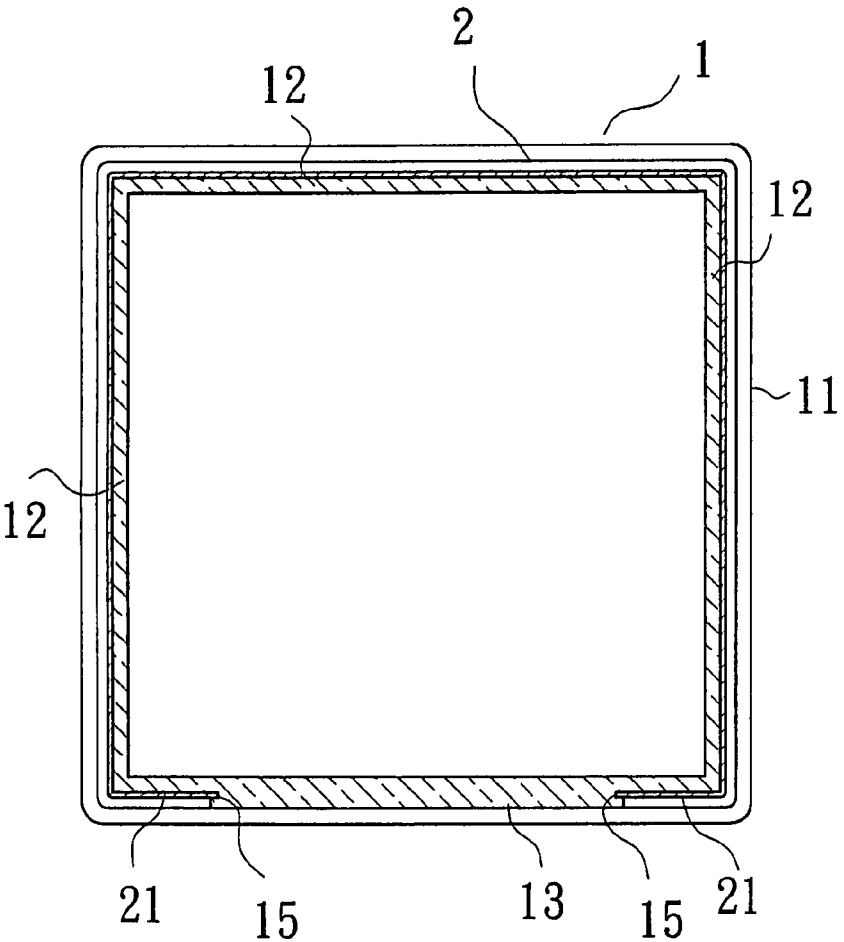
FIG. 7 is a top view of the fourth embodiment.

Referring to FIG. 7, a fourth embodiment of the present invention includes containing body 1, and outer layer member 2, which containing member 1 has fitting trenches 15 formed along raised portion 13 of wall 12 thereof, and which outer layer member 2 is inserted into the fitting trenches 15 of the raised portion 13 at vertical edge portions 21 thereof.

Figure 8:
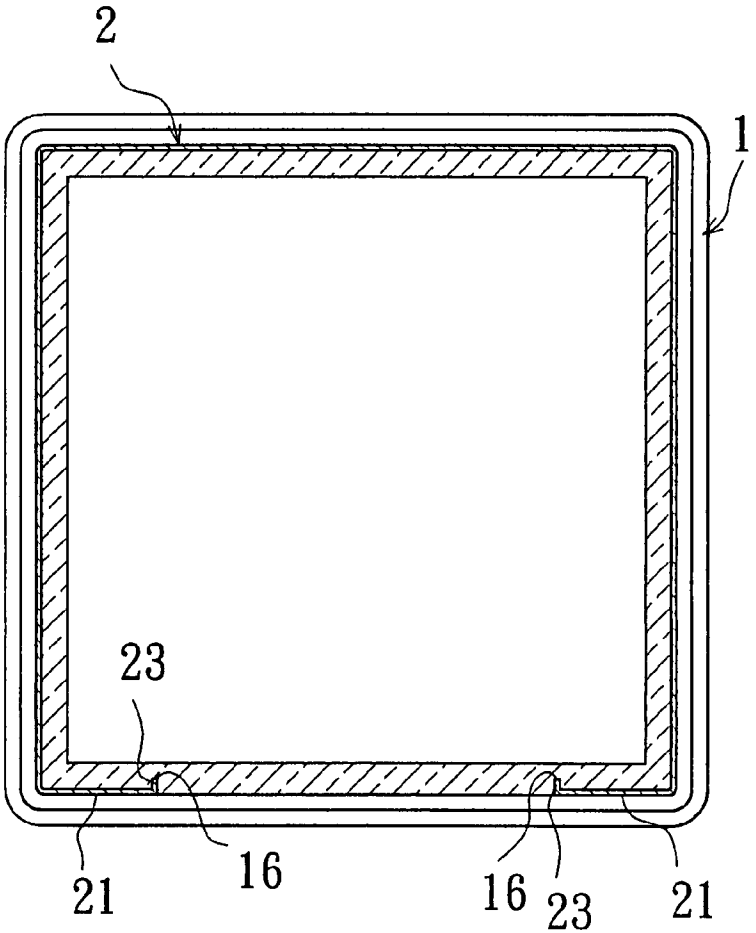
FIG. 8 is a top view of the fifth embodiment.

Referring to FIG. 8, a fifth embodiment of the present invention includes containing body 1, and outer layer member 2, which containing body 1 has fitting trenches 16 formed on recess portion and next to raised portion 13 of wall 12 instead, and which outer layer member 2 has folded edges 23 along edge portions 21 thereof. And, the outer layer member 2 is inserted into the fitting trenches 16 of the containing body 1 at the folded edges 23 thereof.

Figure 9:
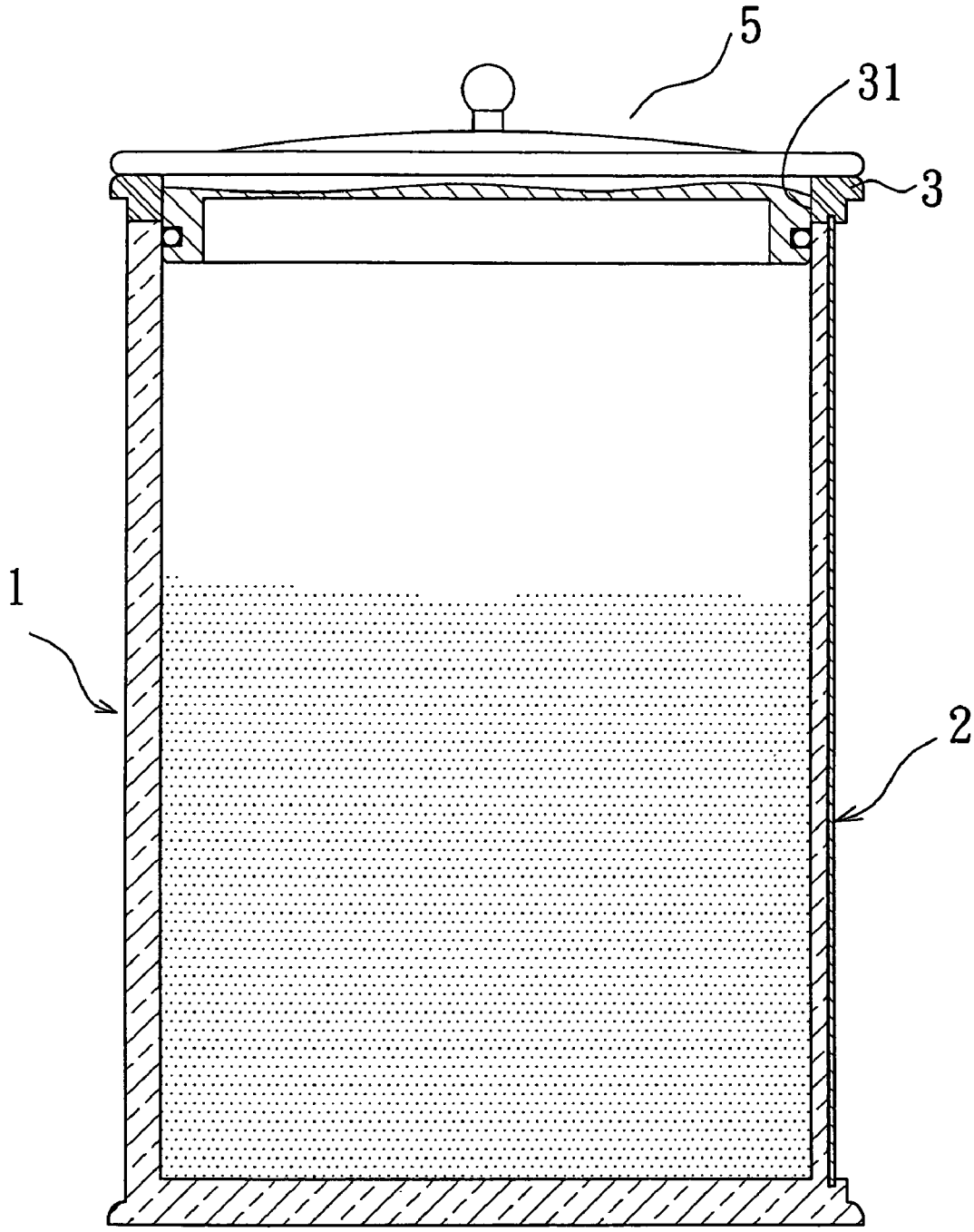
FIG. 9 is a side view of the sixth embodiment.
Figure 10:
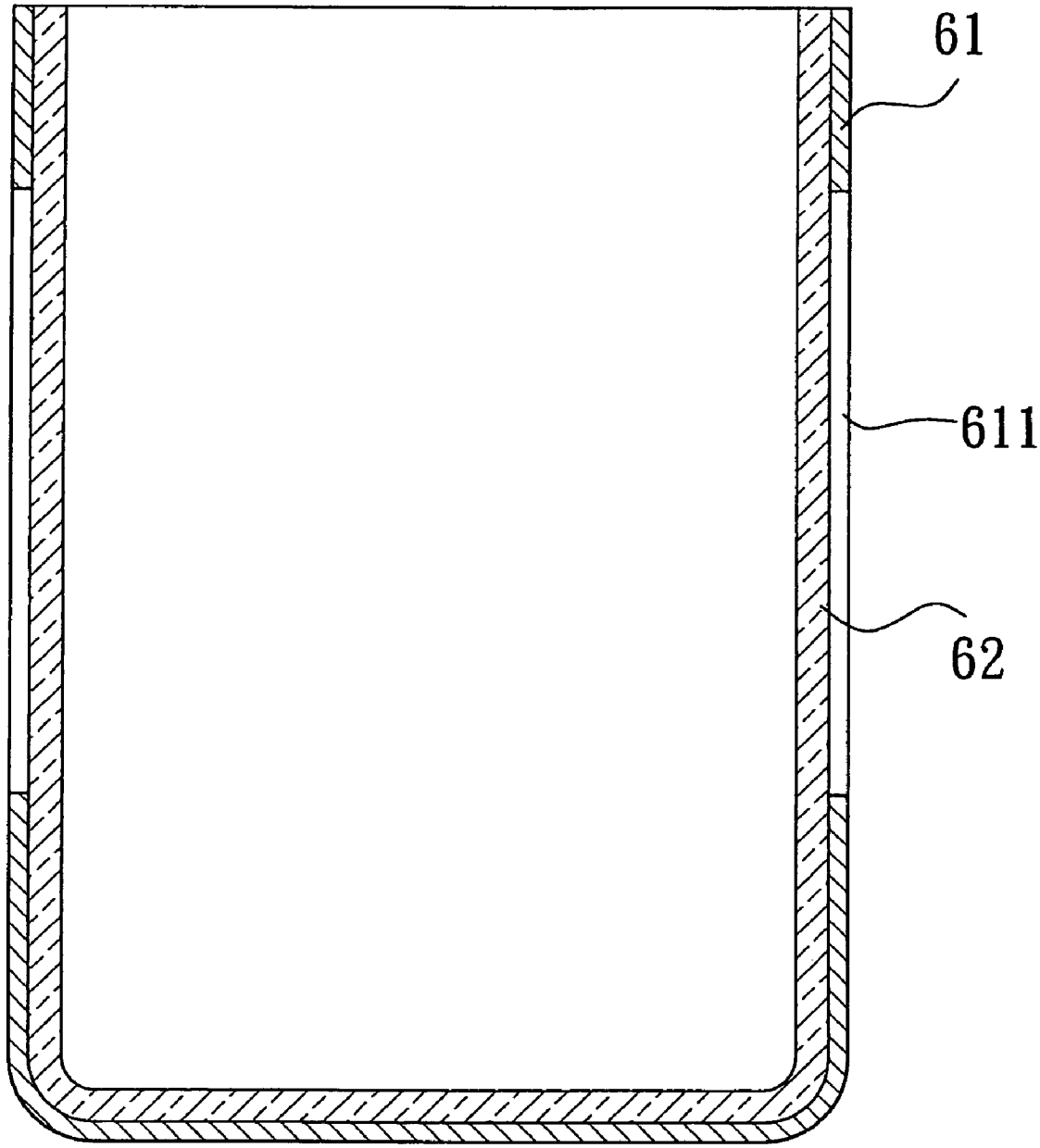
F I G. 10 (PRIOR ART)
FIG. 10 is a vertical section of the conventional container.

Referring to FIG. 9, a sixth embodiment of the present invention is equipped with a lid 5 for sealing an opening 31 of upper part 3 thereof.

From the above description, it can be understood that the present container has the following advantages over the conventional one:

1. The container is more pleasant-looking than the conventional one, and people can see contents of the container through the raised portion of the wall more clearly because the outer layer member is substantially co-planar with the wall of the containing body.

2. The outer layer member and the containing body are firmly joined together because the edges thereof are inserted into the fitting trenches formed on the containing body.

What is claimed is:

1. An improvement on a container, comprising a transparent containing body; the containing body having a base portion, and a wall projecting from the base portion; the wall having a plurality of spaced raised portions on an outer side thereof; the wall having recess portions between the spaced raised portions on the outer side; the base portion being formed with fitting trenches thereon, which are next to the recess portions of the wall;

a plurality of outer layer members closely fitted over the recess portions of the wall; the outer layer members being respectively inserted into the fitting trenches of the base portion at lower ends thereof; and an upper part having an opening, and a fitting trench on a lower side thereof; the upper part being secured on top of both the containing body and the outer layer member with upper ends of the outer layer members being inserted into the fitting trench thereof.

2. The container as claimed in claim 1, wherein the raised portions of the wall of the containing body are formed with trenches along edges thereof, and the outer layer members are inserted into the trenches of the raised portions at edges thereof.

3. The container as claimed in claim 1, wherein the containing body has trenches formed next to the raised portions on the recess portions, and the outer layer members have folded portions along edges thereof; the outer layer members being inserted into the trenches on the recess portions at the folded edge portions thereof.

4. The container as claimed in claim 1 further having a lid removably fitted on the upper part thereof.

5. The container as claimed in claim 1, wherein the upper part is formed with a neck portion, and screw threads on the neck portion while a depressible ejecting member is screwed onto the neck portion, which depressible ejecting member is made in such a way as to be capable of ejecting contents of the container via an outlet when it is depressed.

* * * * *